US012590526B2

(12) United States Patent
Ba et al.

(10) Patent No.: US 12,590,526 B2
(45) Date of Patent: Mar. 31, 2026

(54) WELLBORE DRILL DEVIATION HANDLING

(71) Applicant: Schlumberger Technology Corporation, Sugar Land, TX (US)

(72) Inventors: Samba Ba, Houston, TX (US); Maja Ignova, Stonehouse (GB); Zequn Ye, Houston, TX (US); Si Jine Roh, Houston, TX (US); Vincent Abe, Stonehouse (GB); Ziad Akkaoui, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/818,727

(22) Filed: Aug. 29, 2024

(65) Prior Publication Data

US 2025/0075609 A1 Mar. 6, 2025

Related U.S. Application Data

(60) Provisional application No. 63/580,045, filed on Sep. 1, 2023.

(51) Int. Cl.
*E21B 44/00* (2006.01)
*E21B 7/10* (2006.01)

(52) U.S. Cl.
CPC ..... *E21B 44/00* (2013.01); *E21B 7/10* (2013.01)

(58) Field of Classification Search
CPC ..... E21B 44/00; E21B 7/10
See application file for complete search history.

(56) References Cited

U.S. PATENT DOCUMENTS

| | | | | |
|---|---|---|---|---|
| 11,396,801 | B2 | 7/2022 | Ba et al. | |
| 11,808,131 | B2 | 11/2023 | Ba et al. | |
| 2016/0047220 | A1 | 2/2016 | Sharp et al. | |
| 2019/0085683 | A1 | 3/2019 | Gillan et al. | |
| 2020/0277848 | A1* | 9/2020 | Johnston | E21B 44/00 |
| 2020/0325767 | A1 | 10/2020 | Miller et al. | |
| 2021/0062635 | A1* | 3/2021 | Ameen | E21B 44/04 |
| 2022/0358604 | A1 | 11/2022 | Shen | |
| 2024/0035368 | A1 | 2/2024 | Ba et al. | |

* cited by examiner

*Primary Examiner* — Dany E Akakpo
(74) *Attorney, Agent, or Firm* — Kyle R. Miiller

(57) ABSTRACT

A system for, and method of, drill deviation handling within a stand while drilling a wellbore are presented. The techniques include: receiving, by an electronic processor and during a stand, drill state data; comparing, by the electronic processor and during the stand, the drill state data to an active drill plan; detecting, by the electronic processor and based on the comparing, an out-of-tolerance deviation of a drill parameter; and providing, by the electronic processor, an alert of the out-of-tolerance deviation.

4 Claims, 16 Drawing Sheets

700

1100

1500

WELLBORE DRILL DEVIATION HANDLING

RELATED APPLICATION

This application claims the benefit of U.S. Provisional Patent Application No. 63/580,045, entitled "Wellbore Drill Deviation Handling," and filed Sep. 1, 2023, the disclosure of which is hereby incorporated by reference in its entirety.

FIELD

This disclosure relates generally to wellbore drilling.

BACKGROUND

Drilling wellbores may include drilling with a drillstring that includes multiple drillpipe sections. Multiple (e.g., two or three) single joints of drillpipe sections or drill collars that remain screwed together or otherwise attached, e.g., during tripping operations, may be referred to as a "stand." As the wellbore drilling progresses, additional stands are attached to the drillstring at the surface so that the drillstring may reach further to extend the wellbore. Thus, wellbore drilling is typically performed stand-by-stand, with adjustments to the drillstring trajectory, etc., made only between stands.

SUMMARY

According to various embodiments, a method of drill deviation handling within a stand while drilling a wellbore is presented. The method includes: receiving, by an electronic processor and during a stand, drill state data; comparing, by the electronic processor and during the stand, the drill state data to an active drill plan; detecting, by the electronic processor and based on the comparing, an out-of-tolerance deviation of a drill parameter; and providing, by the electronic processor, an alert of the out-of-tolerance deviation.

Various optional features of the above method embodiments include the following. The method may include automatically adjusting the drill, during the stand, based on the out-of-tolerance deviation. The adjusting may include triggering a working plan generation during the stand. The alert may include a heat map depicting one or more locations of the deviation. The alert may include a depiction of at least one of an inclination an azimuth, a dogleg severity, a turn rate or a build rate, where the depiction includes an annotation of an out-of-tolerance portion. The comparing may include applying a statistical control process. The comparing may include applying a trained machine learning system. The drill state data may include Rotary Steerable System (RSS) data. The drill state data may include Measurement While Drilling (MWD) data. The drill state data may include Logging While Drilling (LWD) data. The drill state data may include mud motor steering data. The drill parameter may include at least one of: azimuth, inclination, dogleg saturation, turn rate, build rate, real time yield, toolface offset, revolutions per minute (RPM), weight on bit, rate of penetration, flow, toolface target, rate of penetration target, steering ratio, and dogleg severity.

According to various embodiments, a system for drill deviation handling within a stand while drilling a wellbore is presented. The system includes a non-transitory memory and an electronic processor, the non-transitory memory communicatively coupled to the electronic processor, where the non-transitory memory includes instructions that, when executed by the electronic processor, configure the electronic processor to perform actions including: receiving, by an electronic processor and during a stand, drill state data; comparing, by the electronic processor and during the stand, the drill state data to an active drill plan; detecting, by the electronic processor and based on the comparing, an out-of-tolerance deviation of a drill parameter; and providing, by the electronic processor, an alert of the out-of-tolerance deviation.

Various optional features of the above system embodiments include the following. The actions may further include automatically adjusting the drill, during the stand, based on the out-of-tolerance deviation. The adjusting may include triggering a working plan generation during the stand. The alert may include a heat map depicting one or more locations of the deviation. The alert may include a depiction of at least one of an inclination an azimuth, a dogleg severity, a turn rate or a build rate, where the depiction includes an annotation of an out-of-tolerance portion. The comparing may include applying a statistical control process. The comparing may include applying a trained machine learning system. The drill state data may include Rotary Steerable System (RSS) data. The drill state data may include Measurement While Drilling (MWD) data. The drill state data may include Logging While Drilling (LWD) data. The drill state data may include mud motor steering data. The drill parameter may include at least one of: azimuth, inclination, dogleg saturation, turn rate, build rate, real time yield, toolface offset, revolutions per minute (RPM), weight on bit, rate of penetration, flow, toolface target, rate of penetration target, steering ratio, and dogleg severity.

According to various embodiments, a method for drilling a wellbore is presented. The method includes: receiving, during a stand, drill state data from a downhole tool in the wellbore, wherein the downhole tool is coupled to a lower end of a drill string that extends into the wellbore from the surface, wherein the downhole tool includes a rotary steerable system (RSS), a measurement while drilling (MWD) tool, a Logging While Drilling (LWD) tool, a mud motor, or a combination thereof, and wherein the drill state data is measured and received from the RSS, the MWD tool, the LWD tool, the mud motor, or a combination thereof; comparing, during the stand, the drill state data to an active drill plan; detecting an out-of-tolerance deviation of a drill parameter of the downhole tool based upon the comparing, wherein the drill parameter includes an azimuth, inclination, dogleg saturation, turn rate, build rate, real time yield, toolface offset, revolutions per minute (RPM), weight on bit, rate of penetration, flow, toolface target, rate of penetration target, steering ratio, dogleg severity, or a combination thereof; providing an alert in response to the out-of-tolerance deviation exceeding a threshold, wherein the alert includes at least one of: a heat map depicting one or more locations of the out-of-tolerance deviation, or an annotated depiction of the drill parameter having the out-of-tolerance deviation; and performing an action in response to the out-of-tolerance deviation exceeding the threshold, wherein the action includes generating and transmitting a signal that instructs or causes a trajectory of the downhole tool or the drill string to vary while a top-most stand of the drill string is gripped and lowered into the wellbore from the surface, and wherein the signal instructs or causes the trajectory to vary before an additional stand is coupled to an upper end of the top-most stand.

According to various embodiments, a method for drilling a wellbore is presented. The method includes:

receiving, during a stand, drill state data from a downhole tool in the wellbore, where the downhole tool is coupled to a lower end of a drill string that extends into the wellbore from the surface, where the downhole tool includes a rotary steerable system (RSS), a measurement while drilling (MWD) tool, a Logging While Drilling (LWD) tool, a mud motor, or a combination thereof, and where the drill state data is measured and received from the RSS, the MWD tool, the LWD tool, the mud motor, or a combination thereof; comparing, during the stand, the drill state data to an active drill plan; detecting an out-of-tolerance deviation of a drill parameter of the downhole tool based upon the comparing, where the drill parameter includes an azimuth, inclination, dogleg saturation, turn rate, build rate, real time yield, toolface offset, revolutions per minute (RPM), weight on bit, rate of penetration, flow, toolface target, rate of penetration target, steering ratio, dogleg severity, or a combination thereof; providing an alert in response to the out-of-tolerance deviation exceeding a threshold, where the alert includes at least one of: a heat map depicting one or more locations of the out-of-tolerance deviation, or an annotated depiction of the drill parameter having the out-of-tolerance deviation; generating a new working plan during the stand automatically and in response to the out-of-tolerance deviation exceeding the threshold; and performing an action specified in the new working plan, where the action includes generating and transmitting a signal that instructs or causes a trajectory of the downhole tool or the drill string to vary while a top-most stand of the drill string is gripped and lowered into the wellbore from the surface, and where the signal instructs or causes the trajectory to vary before an additional stand is coupled to an upper end of the top-most stand.

Combinations, (including multiple dependent combinations) of the above-described elements and those within the specification have been contemplated by the inventors and may be made, except where otherwise indicated or where contradictory.

BRIEF DESCRIPTION OF THE DRAWINGS

Various features of the examples may be more fully appreciated, as the same become better understood with reference to the following detailed description of the examples when considered in connection with the accompanying figures, in which.

DESCRIPTION OF THE EXAMPLES

Reference will now be made in detail to example implementations, illustrated in the accompanying drawings. Wherever convenient, the same reference numbers will be used throughout the drawings to refer to the same or like parts. In the following description, reference is made to the accompanying drawings that form a part thereof, and in which is shown by way of illustration specific exemplary examples in which the invention may be practiced. These examples are described in sufficient detail to enable those skilled in the art to practice the invention and it is to be understood that other examples may be utilized and that changes may be made without departing from the scope of the invention. The following description is, therefore, merely exemplary.

According to various embodiments, a system for and method of wellbore drill deviation handling is presented. The drill deviation handling may perform adjustments to various drill parameters within a stand. That is, the drill deviation handling may perform adjustments, e.g., correcting the trajectory, while a current stand is drilling, rather than waiting for a pause in the drilling while the next stand is installed. This reactive decision making within a stand allows for fine-tuned wellbore drilling and improved wellbore drilling efficiency. Some embodiments detect, and provide alerts for, various drill parameters being out-of-tolerance. Some embodiments automatically adjust drill parameters in response to such detection.

Some embodiments may be used to automatically evaluate steering performance deviations and display steering performance responses against intended behavior when performing a directional drilling job. According to some embodiments, the display provides a powerful assistant to directional drillers, drilling engineers (e.g., post-well analysis), drillers, toolpushers, company men, and all personnel either on or away from the rig site. Some embodiments provide a way for users to evaluate steering responses either as a whole, or in specific zones that may be defined by the user. Some embodiments show in one display what the result of a steering command was and provide guidelines on how to define further commands to achieve the intended response.

These and other features and advantages are shown and described presently in reference to the figures.

Figure 1:
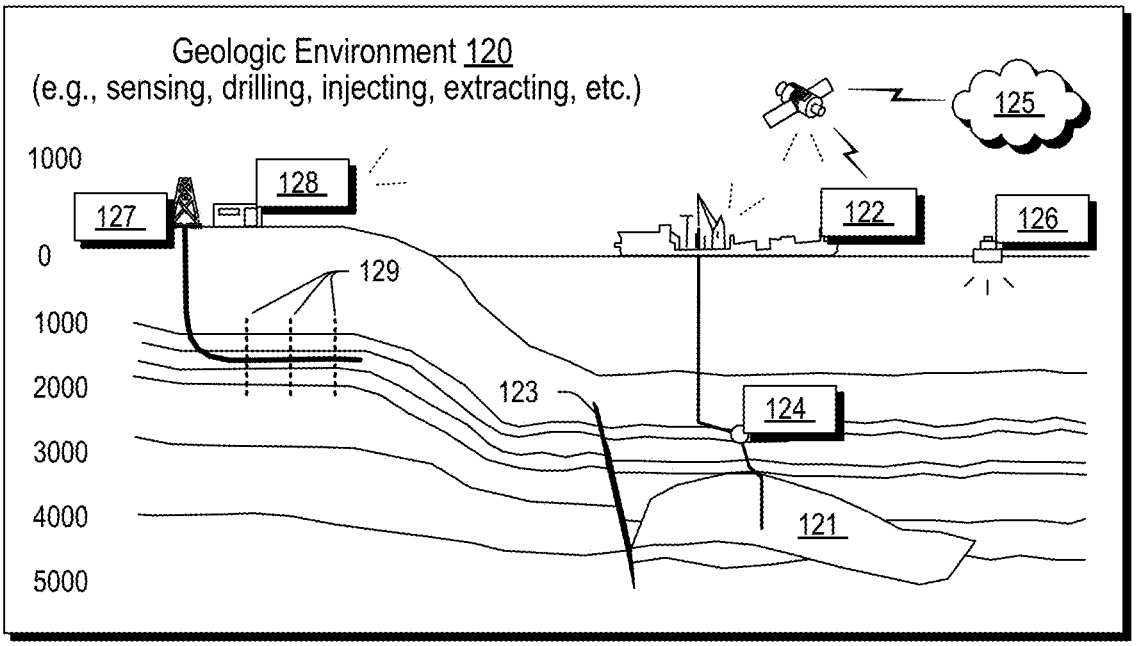
FIG. 1 shows an example of a geologic environment according to various embodiments.
Figure 1:
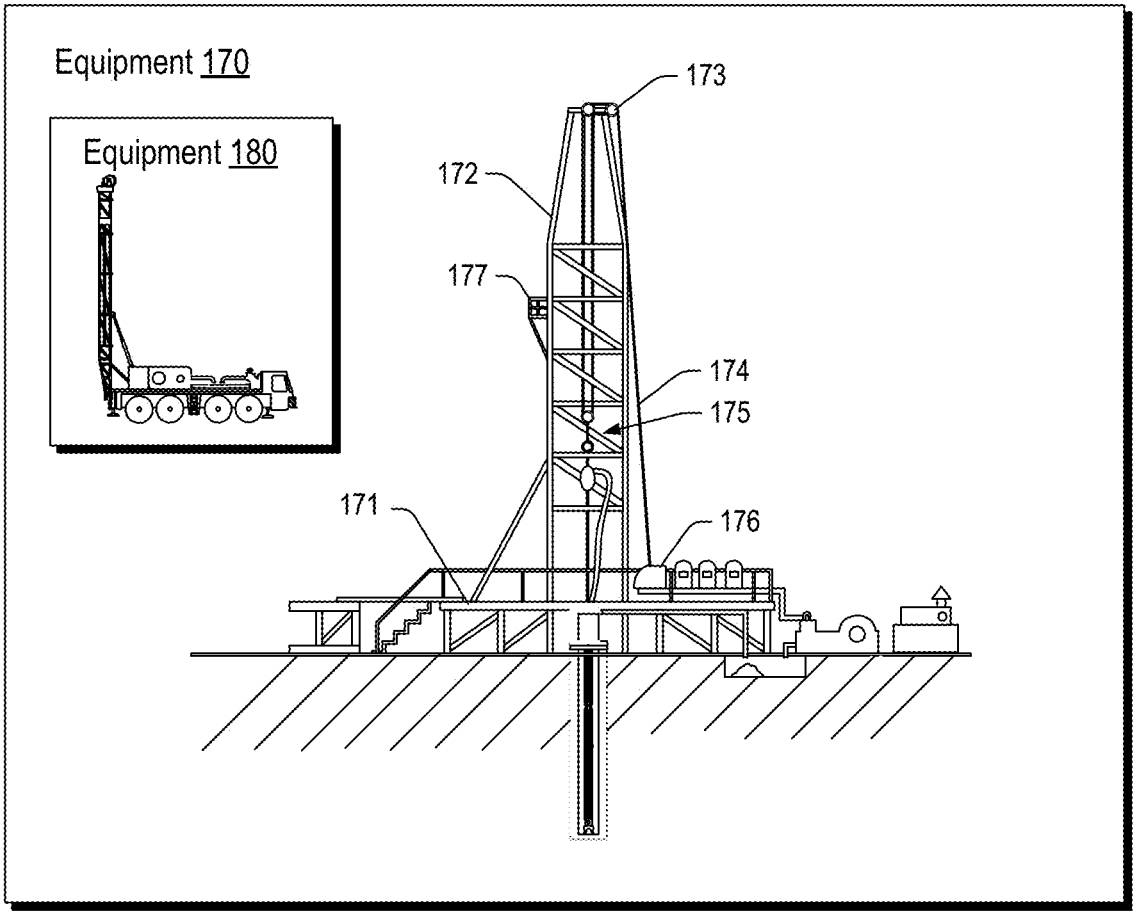

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and/or to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, geolocation, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system. As shown in FIG. 1, the equipment 180 may be mobile as carried by a vehicle; noting that the equipment 170 may be assembled, disassembled, transported and re-assembled, etc.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block assembly 175 may provide an indication as to how much pipe has been deployed.

A derrick may be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line may cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block may include a set of pulleys (e.g., sheaves) that may be located at or near a top of a derrick or a mast, over which line is threaded. A traveling block may include a set of sheaves that may be moved up and down in a derrick or a mast via line threaded in the set of sheaves of the traveling block and in the set of sheaves of a crown block. A crown block, a traveling block and a line may form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrick person may be a rig crew member that works on a platform attached to a derrick or a mast. A derrick may include a landing on which a derrick person may stand. As an example, such a landing may be about 10 meters or more above a rig floor. In an operation referred to as trip out of the hole (TOH), a derrick person may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until it is a time at which it may be desirable to run the pipe back into the bore. As an example, a rig may include automated pipe-handling equipment such that the derrick person controls the machinery rather than physically handling the pipe.

As an example, a trip may refer to the act of pulling equipment from a bore and/or placing equipment in a bore. As an example, equipment may include a drillstring that may be pulled out of the hole and/or place or replaced in the hole. As an example, a pipe trip may be performed where a drill bit has dulled or has otherwise ceased to drill efficiently and is to be replaced.

Figure 2:
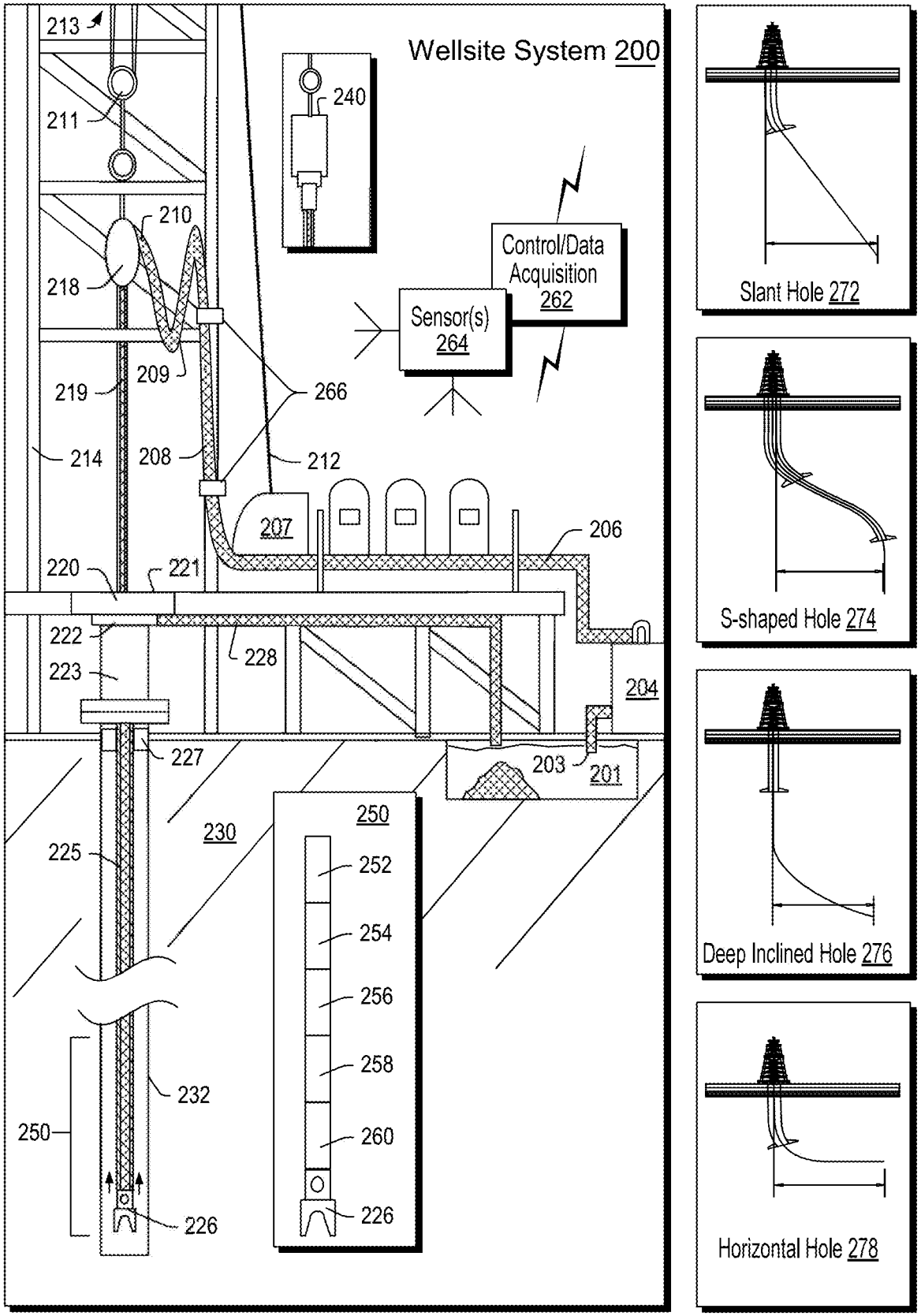
FIG. 2 shows an example of a wellsite system (e.g., at a wellsite that may be onshore or offshore) according to various embodiments.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the platform and the derrick 214 positioned over the borehole 232. As mentioned, the wellsite system 200 may include the rotary table 220 where the drillstring 225 pass through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together (e.g., in stand increments) to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, the mud may thereby circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft. The alternator may include at least one stator winding electrically coupled to a control circuit to selectively short the at least one stator winding to electromagnetically brake the alternator and thereby selectively cease or interrupt rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging while drilling (LWD) module 254, a measuring while drilling (MWD) module 256, an optional module 258, a roto-steerable system and motor 260, and the drill bit 226.

The LWD module 254 may be housed in a suitable type of drill collar and may contain one or a plurality of selected types of logging tools. It will also be understood that more than one LWD module 254 and/or MWD module 256 may be employed, for example, as represented at by the module 256 of the drillstring assembly 250. Where the position of an LWD module 254 is mentioned, as an example, it may refer to a module at the position of the LWD module 254, the MWD module 256, etc. An LWD module may include capabilities for measuring, processing, and storing information, as well as for communicating with the surface equipment. In the illustrated example, the LWD module 254 may include a seismic measuring device.

The MWD module 256 may be housed in a suitable type of drill collar and may contain one or more devices for measuring characteristics of the drillstring 225 and the drill bit 226. As an example, the MWD module 256 may include equipment for generating electrical power, for example, to power various components of the drillstring 225. As an example, the MWD module 256 may include the telemetry equipment 252, for example, where the turbine impeller may generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines a curvature, where an inclination angle with respect to vertical may vary. Such inclination angle may vary until reaching an angle between about 30 degrees and about 60 degrees or, for example, an angle to about 90 degrees or possibly greater than about 90 degrees.

As an example, a directional well may include several shapes where each of the shapes may aim to meet particular operational demands. As an example, a drilling process may be performed on the basis of information as and when it is relayed to a directional driller. As an example, inclination and/or direction may be modified based on information received during a drilling process.

As an example, deviation of a bore may be accomplished in part by use of a downhole motor and/or a turbine. As to a motor, for example, a drillstring may include a positive displacement motor (PDM).

As an example, a system may be a steerable system and include equipment to perform method such as geosteering. As an example, a steerable system may include a PDM of a turbine that may be disposed upon a lower part of a drillstring at which, just above a drill bit, a bent sub may be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include an azimuthal density neutron (AND) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be disposed at one or more remote locations that are not within a distance of the order of about one hundred meters from the wellsite system 200. As an example, a sensor or sensor may be disposed at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266. In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

As an example, one or more portions of a drillstring may become stuck. The term stuck may refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this may refer to a portion of a drillstring that cannot be rotated or moved axially. As an example, a condition referred to as "differential sticking" may be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking may result in time and financial cost.

As an example, a sticking force may be a product of the differential pressure between the wellbore and the reservoir and the area that the differential pressure is acting upon. Accordingly, a relatively low differential pressure (delta p) that is applied over a large working area may be just as effective in sticking pipe as a high differential pressure that is applied over a small area.

As an example, a condition referred to as "mechanical sticking" may be a condition where limiting or prevention of motion of the drillstring by a mechanism other than differential pressure sticking occurs. Mechanical sticking may be caused, for example, by one or more of junk in the hole, wellbore geometry anomalies, cement, keyseats or a buildup of cuttings in the annulus.

Figure 3:
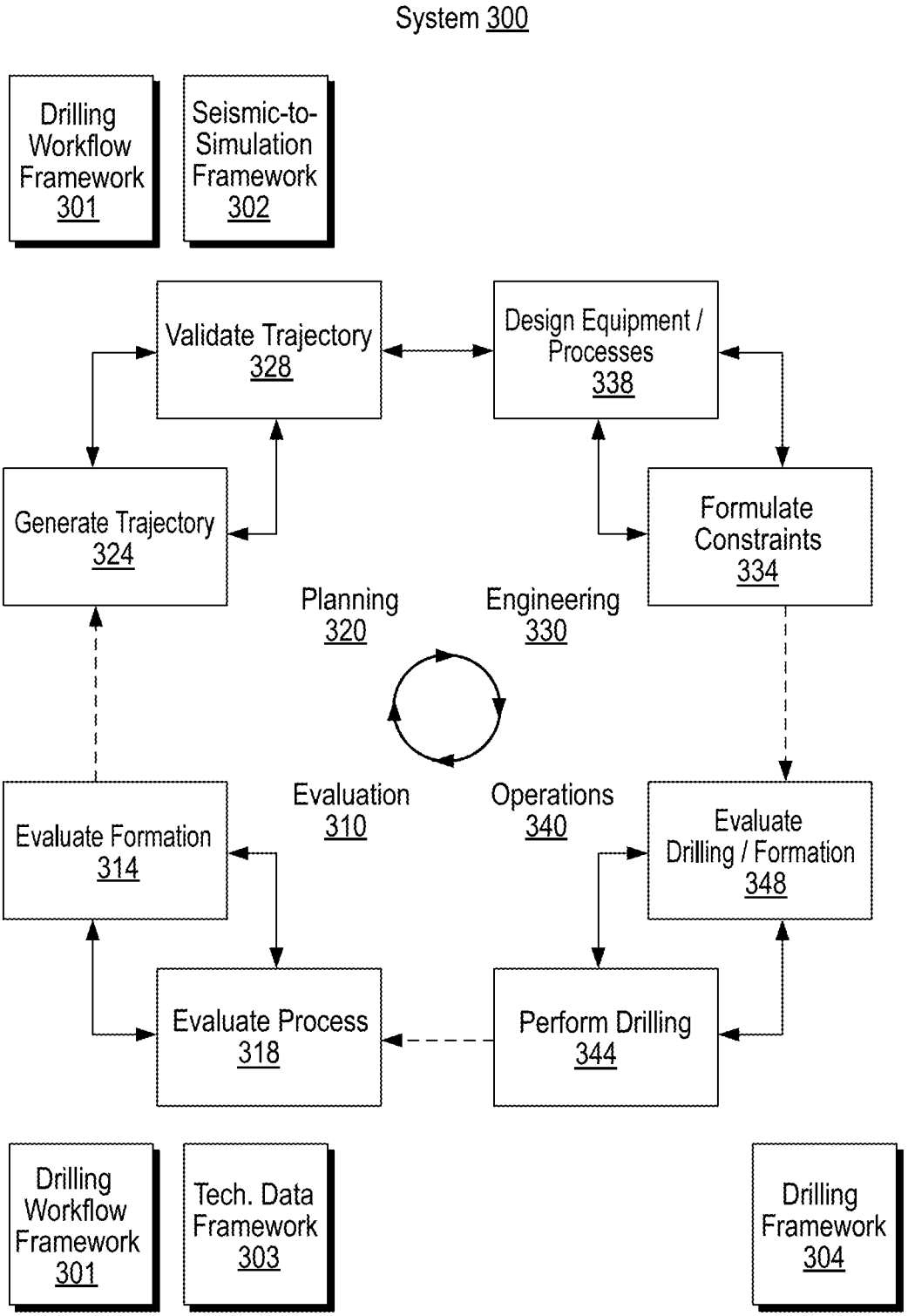
FIG. 3 shows an example of a system that includes various equipment for evaluation, planning, engineering and operations according to various embodiments.

FIG. 3 shows an example of a system 300 that includes various equipment for evaluation 310, planning 320, engineering 330 and operations 340. For example, a drilling workflow framework 301, a seismic-to-simulation framework 302, a technical data framework 303 and a drilling framework 304 may be implemented to perform one or more processes such as a evaluating a formation 314, evaluating a process 318, generating a trajectory 324, validating a trajectory 328, formulating constraints 334, designing equipment and/or processes based at least in part on constraints 338, performing drilling 344 and evaluating drilling and/or formation 348.

In the example of FIG. 3, the seismic-to-simulation framework 302 may be, for example, the PETREL® framework (Schlumberger Limited, Houston, Texas) and the technical data framework 303 may be, for example, the TECHLOG® framework (Schlumberger Limited, Houston, Texas).

As an example, a framework may include entities that may include earth entities, geological objects or other objects such as wells, surfaces, reservoirs, etc. Entities may include virtual representations of actual physical entities that are reconstructed for purposes of one or more of evaluation, planning, engineering, operations, etc.

Entities may include entities based on data acquired via sensing, observation, etc. (e.g., seismic data and/or other information). An entity may be characterized by one or more properties (e.g., a geometrical pillar grid entity of an earth model may be characterized by a porosity property). Such properties may represent one or more measurements (e.g., acquired data), calculations, etc.

A framework may be an object-based framework. In such a framework, entities may include entities based on predefined classes, for example, to facilitate modeling, analysis, simulation, etc. A commercially available example of an object-based framework is the MICROSOFT™ .NET™ framework (Redmond, Washington), which provides a set of extensible object classes. In the .NET™ framework, an object class encapsulates a module of reusable code and associated data structures. Object classes may be used to instantiate object instances for use in by a program, script, etc. For example, borehole classes may define objects for representing boreholes based on well data.

As an example, a framework may include an analysis component that may allow for interaction with a model or model-based results (e.g., simulation results, etc.). As to simulation, a framework may operatively link to or include a simulator such as the ECLIPSE® reservoir simulator (Schlumberger Limited, Houston Texas), the INTERSECT® reservoir simulator (Schlumberger Limited, Houston Texas), etc.

The aforementioned PETREL® framework provides components that allow for optimization of exploration and development operations. The PETREL® framework includes seismic to simulation software components that may output information for use in increasing reservoir performance, for example, by improving asset team productivity. Through use of such a framework, various professionals (e.g., geophysicists, geologists, well engineers, reservoir engineers, etc.) may develop collaborative workflows and integrate operations to streamline processes. Such a framework may be considered an application and may be considered a data-driven application (e.g., where data is input for purposes of modeling, simulating, etc.).

As an example, one or more frameworks may be interoperative and/or run upon one or another. As an example, consider the commercially available framework environment marketed as the OCEAN® framework environment (Schlumberger Limited, Houston, Texas), which allows for integration of add-ons (or plug-ins) into a PETREL® framework workflow. The OCEAN® framework environment leverages .NET™ tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

As an example, a framework may include a model simulation layer along with a framework services layer, a framework core layer and a modules layer. The framework may include the commercially available OCEAN® framework where the model simulation layer may include or operatively link to the commercially available PETREL® model-centric software package that hosts OCEAN® framework applications. In an example embodiment, the PETREL® software may be considered a data-driven application. The PETREL® software may include a framework for model building and visualization. Such a model may include one or more grids.

As an example, the model simulation layer may provide domain objects, act as a data source, provide for rendering and provide for various user interfaces. Rendering may provide a graphical environment in which applications may display their data while the user interfaces may provide a common look and feel for application user interface components.

As an example, domain objects may include entity objects, property objects and optionally other objects. Entity objects may be used to geometrically represent wells, surfaces, reservoirs, etc., while property objects may be used to provide property values as well as data versions and display parameters. For example, an entity object may represent a well where a property object provides log information as well as version information and display information (e.g., to display the well as part of a model).

As an example, data may be stored in one or more data sources (or data stores, generally physical data storage devices), which may be at the same or different physical sites and accessible via one or more networks. As an example, a model simulation layer may be configured to model projects. As such, a particular project may be stored where stored project information may include inputs, models, results and cases. Thus, upon completion of a modeling session, a user may store a project. At a later time, the project may be accessed and restored using the model simulation layer, which may recreate instances of the relevant domain objects.

As an example, the system 300 may be used to perform one or more workflows. A workflow may be a process that includes a number of worksteps. A workstep may operate on data, for example, to create new data, to update existing data, etc. As an example, a workflow may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable at least in part in the PETREL® software, for example, that operates on seismic data, seismic attribute(s), etc.

As an example, seismic data may be data that is acquired via a seismic survey where sources and receivers are positioned in a geologic environment to emit and receive seismic energy where at least a portion of such energy may reflect off subsurface structures. As an example, a seismic data analysis framework or frameworks (e.g., consider the OMEGA® framework, marketed by Schlumberger Limited, Houston, Texas) may be utilized to determine depth, extent, properties, etc. of subsurface structures. As an example, seismic data analysis may include forward modeling and/or inversion, for example, to iteratively build a model of a subsurface region of a geologic environment. As an example, a seismic data analysis framework may be part of or operatively coupled to a seismic-to-simulation framework (e.g., the PETREL® framework, etc.).

As an example, a workflow may be a process implementable at least in part in the OCEAN® framework. As an example, a workflow may include one or more worksteps that access a module such as a plug-in (e.g., external executable code, etc.).

As an example, a framework may provide for modeling petroleum systems. For example, the commercially available modeling framework marketed as the PETROMOD® framework (Schlumberger Limited, Houston, Texas) includes features for input of various types of information (e.g., seismic, well, geological, etc.) to model evolution of a sedimentary basin. The PETROMOD® framework provides for petroleum systems modeling via input of various data such as seismic data, well data and other geological data, for example, to model evolution of a sedimentary basin. The PETROMOD® framework may predict if, and how, a reservoir has been charged with hydrocarbons, including, for example, the source and timing of hydrocarbon generation, migration routes, quantities, pore pressure and hydrocarbon type in the subsurface or at surface conditions. In combination with a framework such as the PETREL® framework, workflows may be constructed to provide basin-to-prospect scale exploration solutions. Data exchange between frameworks may facilitate construction of models, analysis of data (e.g., PETROMOD® framework data analyzed using PETREL® framework capabilities), and coupling of workflows.

As mentioned, a drillstring may include various tools that may make measurements. As an example, a wireline tool or another type of tool may be utilized to make measurements. As an example, a tool may be configured to acquire electrical borehole images. As an example, the fullbore Formation MicroImager (FMI) tool (Schlumberger Limited, Houston, Texas) may acquire borehole image data. A data acquisition sequence for such a tool may include running the tool into a borehole with acquisition pads closed, opening and pressing the pads against a wall of the borehole, delivering electrical current into the material defining the borehole while translating the tool in the borehole, and sensing current remotely, which is altered by interactions with the material.

Analysis of formation information may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). As an example, information acquired by a tool or tools may be analyzed using a framework such as the TECHLOG® framework. As an example, the TECHLOG® framework may be interoperable with one or more other frameworks such as, for example, the PETREL® framework.

Figure 4:
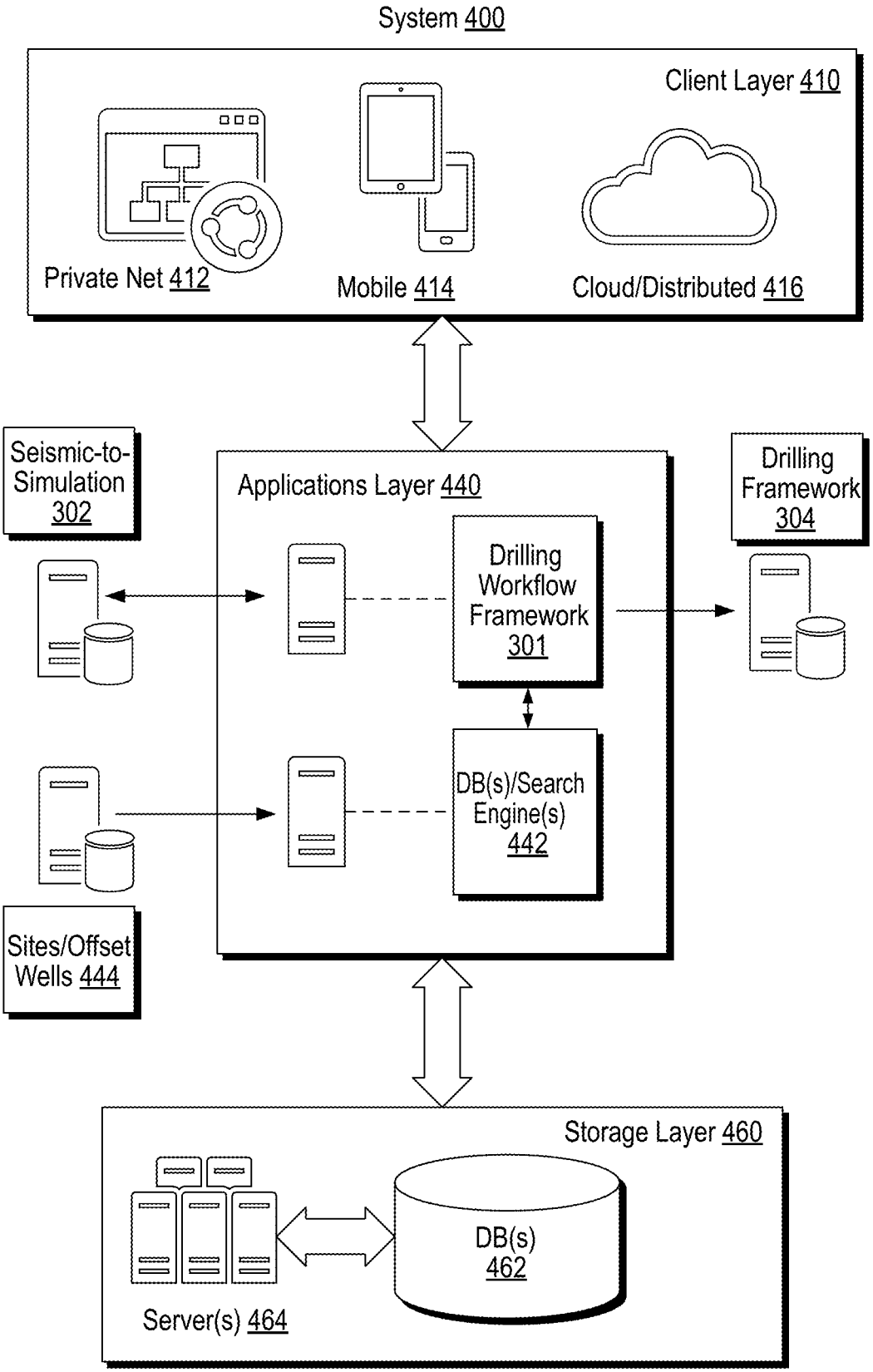
FIG. 4 shows an example of a system that includes a client layer, an applications layer and a storage layer according to various embodiments.

FIG. 4 shows an example of a system 400 that includes a client layer 410, an applications layer 440 and a storage layer 460. As shown the client layer 410 may be in communication with the applications layer 440 and the applications layer 440 may be in communication with the storage layer 460.

The client layer 410 may include features that allow for access and interactions via one or more private networks 412, one or more mobile platforms and/or mobile networks 414 and via the "cloud" 416, which may be considered to include distributed equipment that forms a network such as a network of networks.

In the example of FIG. 4, the applications layer 440 includes the drilling workflow framework 301 as mentioned with respect to the example of FIG. 3. The applications layer 440 also includes a database management component 442 that includes one or more search engines modules.

As an example, the database management component 442 may include one or more search engine modules that provide for searching one or more information that may be stored in one or more data repositories. As an example, the STUDIO E&P™ knowledge environment (Schlumberger Ltd., Houston, Texas) includes STUDIO FIND™ search functionality, which provides a search engine. The STUDIO FIND™ search functionality also provides for indexing content, for example, to create one or more indexes. As an example, search functionality may provide for access to public content, private content or both, which may exist in one or more databases, for example, optionally distributed and accessible via an intranet, the Internet or one or more other networks. As an example, a search engine may be configured to apply one or more filters from a set or sets of filters, for example, to enable users to filter out data that may not be of interest.

As an example, a framework may provide for interaction with a search engine and, for example, associated features such as features of the STUDIO FIND™ search functionality. As an example, a framework may provide for implementation of one or more spatial filters (e.g., based on an area viewed on a display, static data, etc.). As an example, a search may provide access to dynamic data (e.g., "live" data from one or more sources), which may be available via one or more networks (e.g., wired, wireless, etc.). As an example, one or more modules may optionally be implemented within a framework or, for example, in a manner operatively coupled to a framework (e.g., as an add-on, a plug-in, etc.). As an example, a module for structuring search results (e.g., in a list, a hierarchical tree structure, etc.) may optionally be implemented within a framework or, for example, in a manner operatively coupled to a framework (e.g., as an add-on, a plug-in, etc.).

In the example of FIG. 4, the applications layer 440 may include communicating with one or more resources such as, for example, the seismic-to-simulation framework 302, the drilling framework 304 and/or one or more sites 444, which may include one or more offset wellsites. As an example, the applications layer 440 may be implemented for a particular wellsite where information may be processed as part of a workflow for operations such as, for example, operations performed, being performed and/or to be performed at the particular wellsite. As an example, an operation may involve directional drilling, for example, via geosteering.

In the example of FIG. 4, the storage layer 460 may include various types of data, information, etc., which may be stored in one or more databases 462. As an example, one or more servers 464 may provide for management, access, etc., to data, information, etc., stored in the one or more databases 462. As an example, the database management component 442 may provide for searching as to data, information, etc., stored in the one or more databases 462.

As an example, the database management component 442 may include features for indexing, etc. As an example, information may be indexed at least in part with respect to a wellsite. For example, where the applications layer 440 is implemented to perform one or more workflows associated with a particular wellsite, data, information, etc., associated with that particular wellsite may be indexed based at least in part on the wellsite being an index parameter (e.g., a search parameter).

As an example, the system 400 of FIG. 4 may be implemented to perform one or more portions of one or more workflows associated with the system 300 of FIG. 3. For example, the drilling workflow framework 301 may interact with the technical data framework 303 and the drilling framework 304 before, during and/or after performance of one or more drilling operations. In such an example, the one or more drilling operations may be performed in a geologic environment (see, e.g., the environment 120 of FIG. 1) using one or more types of equipment (see, e.g., equipment of FIGS. 1 and 2).

Figure 5:
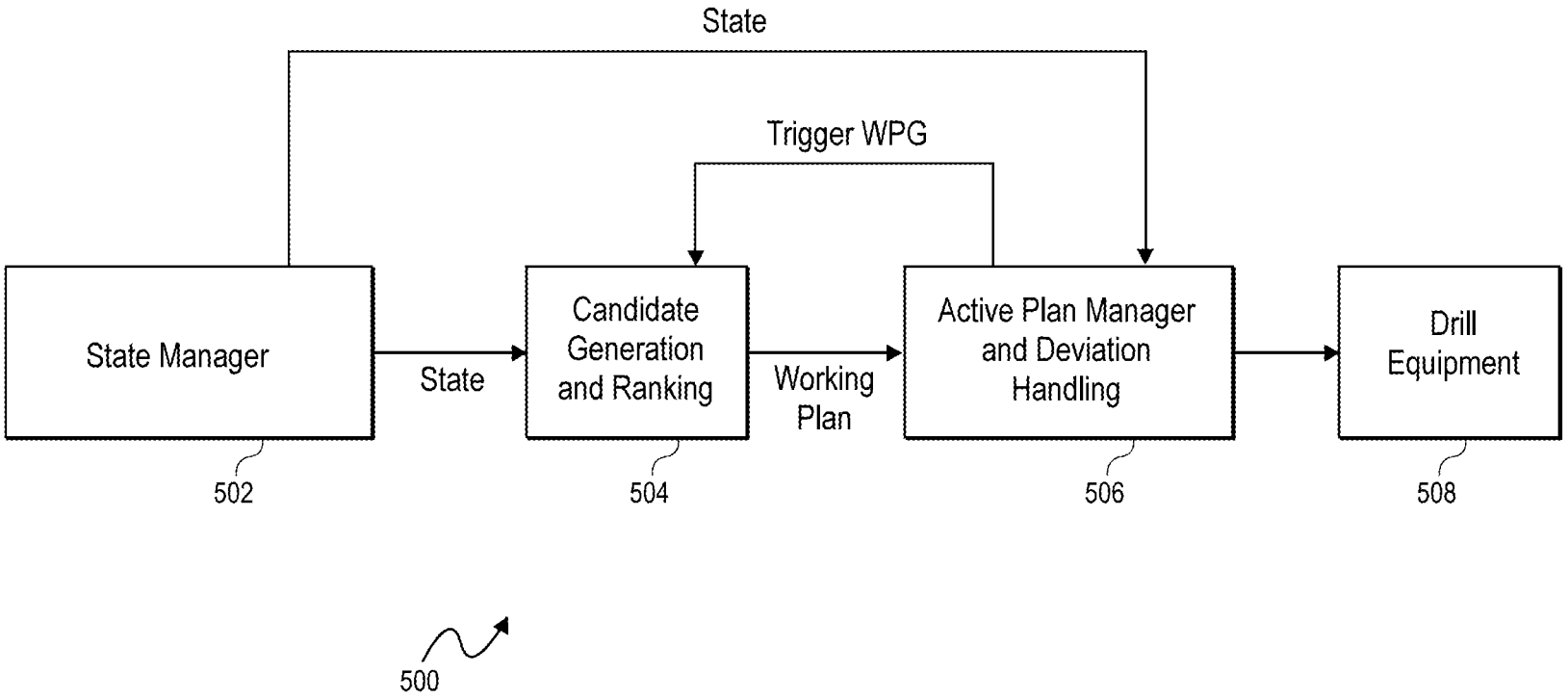
FIG. 5 is a schematic diagram of a steering application that includes a deviation handler according to various embodiments.

FIG. 5 is a schematic diagram of a steering application 500 that includes a deviation handler in an active plan manager and deviation handling module 506, according to various embodiments. The steering application 500 includes a state manager 502, a candidate generation and ranking module 504, and an active plan manager and deviation handling module 506. The steering application 500 is communicatively coupled to, and controls, drill equipment 508.

In general, the state manager 502 obtains state data regarding the drillstring periodically, e.g., every second. The state data may be obtained at the surface or downhole. The state data may be obtained from a Rotary Steerable System (RSS), a Measurement While Drilling (MWD) system, a mud motor steering system, and/or any of a variety of other drillstring sensors or state data sources, e.g., as shown and described herein in reference to FIGS. 1-4.

The candidate generation and ranking module 504 generates candidate drill plans and ranks them according to one or more criteria. A top-ranked candidate drill plan may be selected as an active drill plan for a stand and provided to the active plan manager and deviation handling module 506. The candidate plan generation, ranking, and active drill plan selection may be performed regularly, between stands, and sporadically, as triggered by a deviation handler as described herein. For example, an active drill plan may be used from the beginning of a stand through the end of the stand, unless a new active drill plan generation is triggered before then. The candidate drill plans may include specifications of one or more drill parameters. Drill parameters may include, by way of non-limiting examples: azimuth, inclination, dogleg saturation, turn rate, build rate real time yield, toolface offset, revolutions per minute (RPM), weight on bit, rate of penetration, and flow.

The active plan manager and deviation handling module 506 includes logic that compares an active drill plan, e.g., as provided by the active plan manager and deviation handling module 506, to actual drill parameters, e.g., as provided by the state manager 502. If the comparison results indicate a difference that is out-of-tolerance, the active plan manager and deviation handling module 506 may perform various actions, such as providing an alert and/or triggering the generation of a new active drill plan. Such actions may be performed within a stand or between stands according to various embodiments. By way of non-limiting example, the comparison may include determining whether any of azimuth, inclination, dogleg saturation, turn rate, build rate real time yield, toolface offset, revolutions per minute (RPM), weight on bit, rate of penetration, flow, downlink reception, tool malfunction, or steering efficiency factor are out-of-tolerance, e.g., by determining whether a difference between the actual parameter and the parameter as represented in the active drill plan exceeds a specified threshold. Further example comparisons and details are shown and described herein in reference to FIGS. 6 and 16 (reference 1604).

The drill equipment 508 may include any, or any combination, of drill equipment, e.g., as shown and described herein in reference to FIGS. 1-4.

Figure 6:
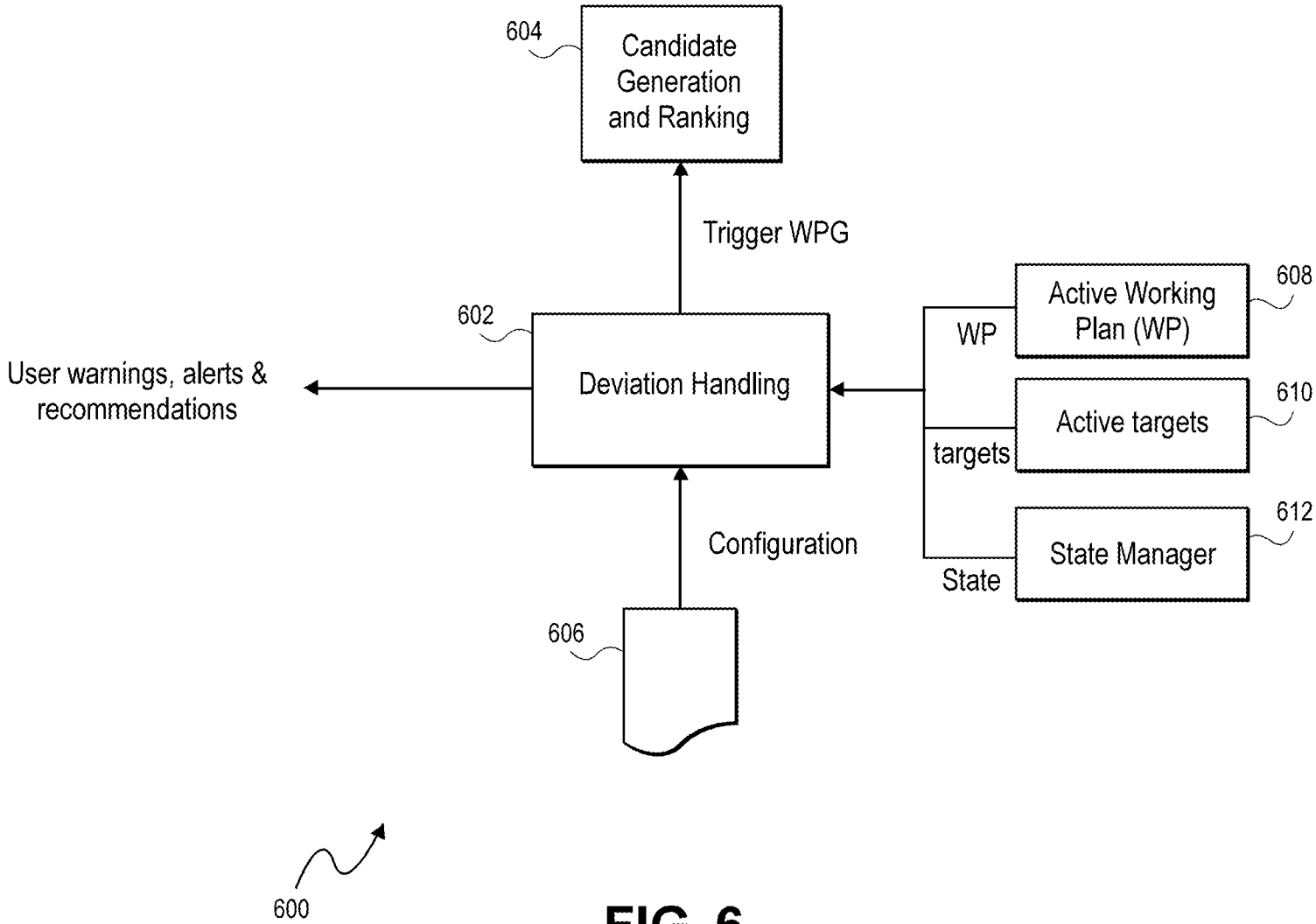
FIG. 6 is a schematic diagram of a deviation handler according to various embodiments.

FIG. 6 is a schematic diagram of a deviation handler 600 according to various embodiments. The deviation handler 600 may form part of the active plan manager and deviation handling module 506 as shown and described herein in reference to FIG. 5. The deviation handler 600 includes a deviation handling module 602, a candidate generation and ranking module 604, and configuration information 606. The deviation handler 600 is configured to receive an active working plan 608, active targets 610, and state data from the state manager 612.

The deviation handling module 602 compares the state data from the state manager 612 to the active working plan 608 (with active targets 610) to determine whether the actual state is out-of-tolerance. By way of non-limiting example, a suitable threshold for inclination is ±2° and a suitable threshold for azimuth is ±5°. Further example thresholds are described herein in reference to FIG. 8. If an out-of-tolerance difference is detected, the deviation handling module 602 may trigger a new working plan generation at the candidate generation and ranking module 604. The deviation handling module 602 also receives configuration information 606, which may include, e.g., the particular hardware and tool used in the drillstring, such as the steering mechanism, which may inform whether the actual state is out of tolerance.

Thus, the deviation handling module 602 is in charge of automatically monitoring and reacting to significant deviations from what is expected from the system. When such a deviation is detected, the deviation handling module 602 may trigger an alarm or warning to the user(s). In some cases, it may intervene and trigger an automatic working plan generation to rectify the current course. The deviation handling module 602 will thus monitor the current state of the system and may trigger the emergency generation of a new working plan to respond unwanted deviations. According to some embodiments, the new working plan is automatically (e.g., without human intervention) implemented. Thus, some embodiments may automatically adjust a drill during a stand based on out-of-tolerance deviations.

Any of a variety of states may be monitored for significant deviations. Non-limiting examples include: azimuth, inclination, dogleg saturation, turn rate, build rate real time yield, toolface offset, revolutions per minute (RPM), weight on bit, rate of penetration, flow, downlink reception, tool malfunction, and steering efficiency factor.

Figure 7:
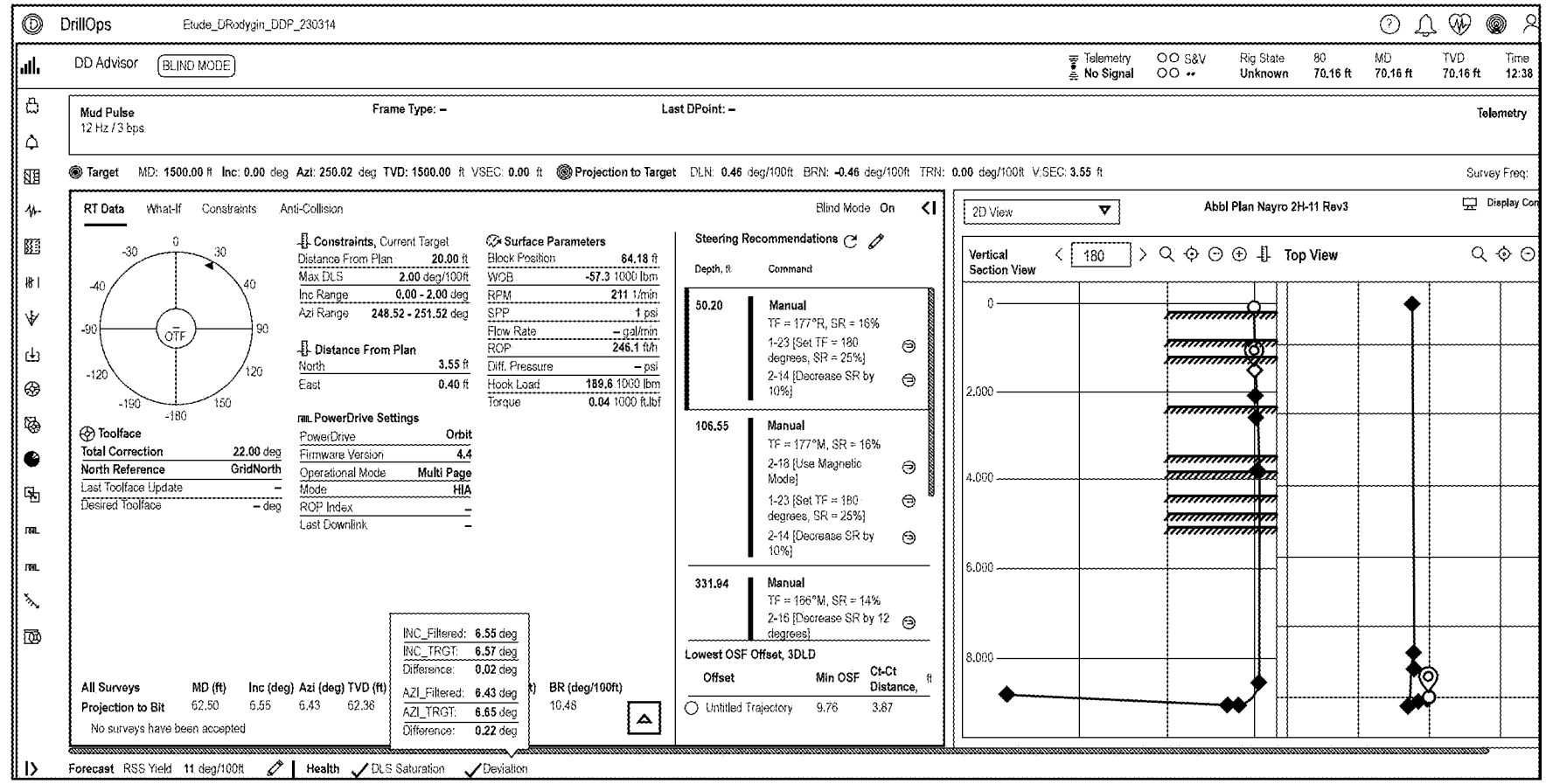
FIG. 7 is a screenshot of a deviation handler application according to various embodiments.

FIG. 7 is a screenshot 700 of a deviation handler application according to various embodiments. In general, a deviation handler, e.g., as shown and described herein in reference to FIGS. 5 and 6, may display results versus an intended performance, send user warnings, visual and/or audible alerts, and recommendations, and trigger a new working plan generation. The screenshot 700 illustrates some of these functions. For example, the left side of the screenshot 700 includes a depiction of a toolface offset correction at 22° north. A circular iconic representation shows the correction graphically. As another example, the right side of the screenshot 700 shows a wellbore sectional view, with both a vertical sectional view and a top sectional view. These views may depict both the working plan wellbore, the actual state, and any corrections made.

For a Rotary Steerable System (RSS) application, the steering response may be used as part of the RSS performance page, which highlights for each downlink command the performance of the RSS tool in terms of steering and ROP (Rate of Penetration).

Figure 8:
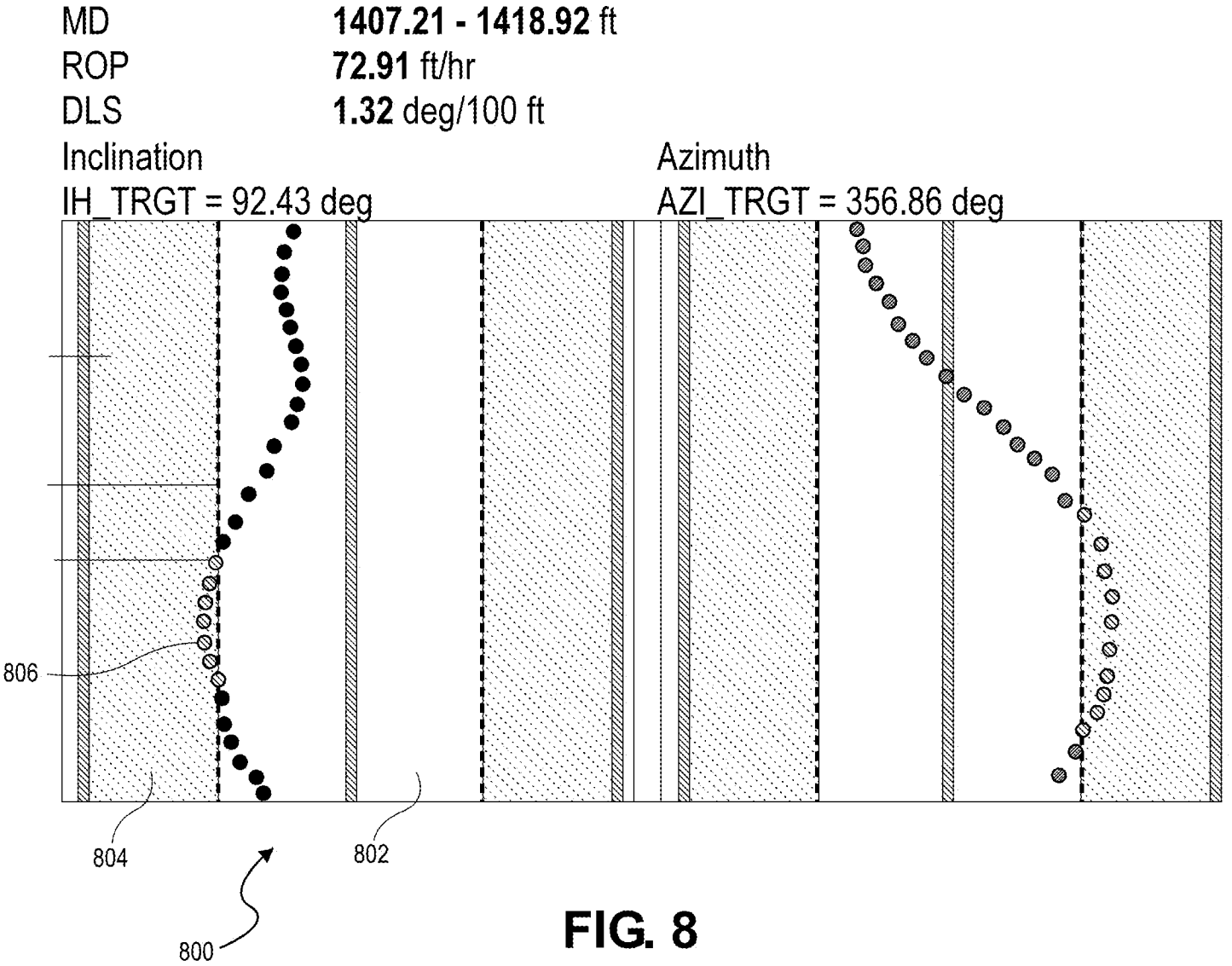
FIG. 8 is a partial screenshot showing graphical depictions of inclination and azimuth, with annotations of out-of-tolerance portions according to various embodiments.

FIG. 8 is a partial screenshot 800 showing graphical depictions of inclination and azimuth, with annotations of out-of-tolerance portions according to various embodiments. In particular, the screenshot 800 depicts graphical displays for both inclination (on the left) and azimuth (on the right). Respective active targets are noted above the graphical displays.

By way of non-limiting example, the within-tolerance regions (e.g., 802) are depicted in white, and the out-of-tolerance regions (e.g., 804) are depicted as shaded. The graphical depiction of the actual state data 806 is depicted in one shade (or color) when it lies within the within-tolerance regions and depicted in a different shade (or color) when it lies within the out-of-tolerance regions. Note that although FIG. 8 depicts different regions and state data in different shades, embodiments are not so limited. Different colors, shapes, etc. may be used in alternate embodiments.

By way of non-limiting example, the screenshot 800 of FIG. 8 is shown for automated monitoring when using an RSS hold-azimuth-inclination (HIA) mode, where azimuth and inclination are monitored for significant deviations and other parameters are allowed to vary. A deviation handler according to various embodiments may track the values of inclination and azimuth in between downlink commands and provide warnings to users when a certain threshold is exceeded as shown by the shaded regions. This allows the user to react, if needed, including deciding to exit the HIA mode if the tool performance is not satisfactory.

Non-limiting examples of thresholds for out-of-tolerance are presented below.

For Warnings:

- RSS Sensor EKF Inclination deviation from target by more than 0.75°
- RSS Sensor EKF Azimuth deviation from target by more than 2.5°

For Failures:

- RSS Sensor EKF Inclination deviation from target by more than 1.5°
- RSS Sensor EKF Azimuth deviation from target by more than 5°

Figure 9:
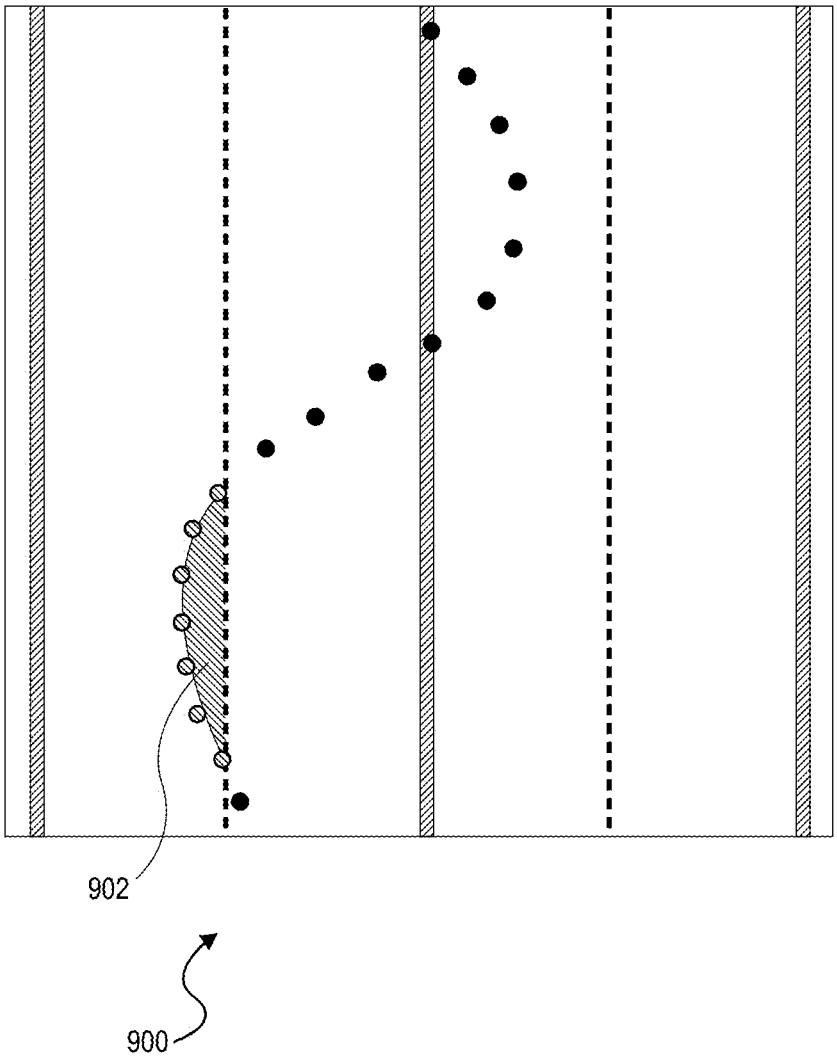
FIG. 9 is a partial screenshot showing a graphical depiction of a drilling parameter with an annotation of an out-of-tolerance portion according to various embodiments.

FIG. 9 is a partial screenshot 900 showing a graphical depiction of a drilling parameter with an annotation of an out-of-tolerance portion according to various embodiments. The graphical depiction is similar to that of FIG. 8, except that, for the out-of-tolerance portion, the area 902 between the out-of-tolerance threshold and the actual state is depicted in a different shade than the background of the out-of-tolerance region. Note that although FIG. 9 depicts this area in a different shade, embodiments are not so limited. Different colors, shapes, etc. may be used in alternate embodiments.

Figure 10:
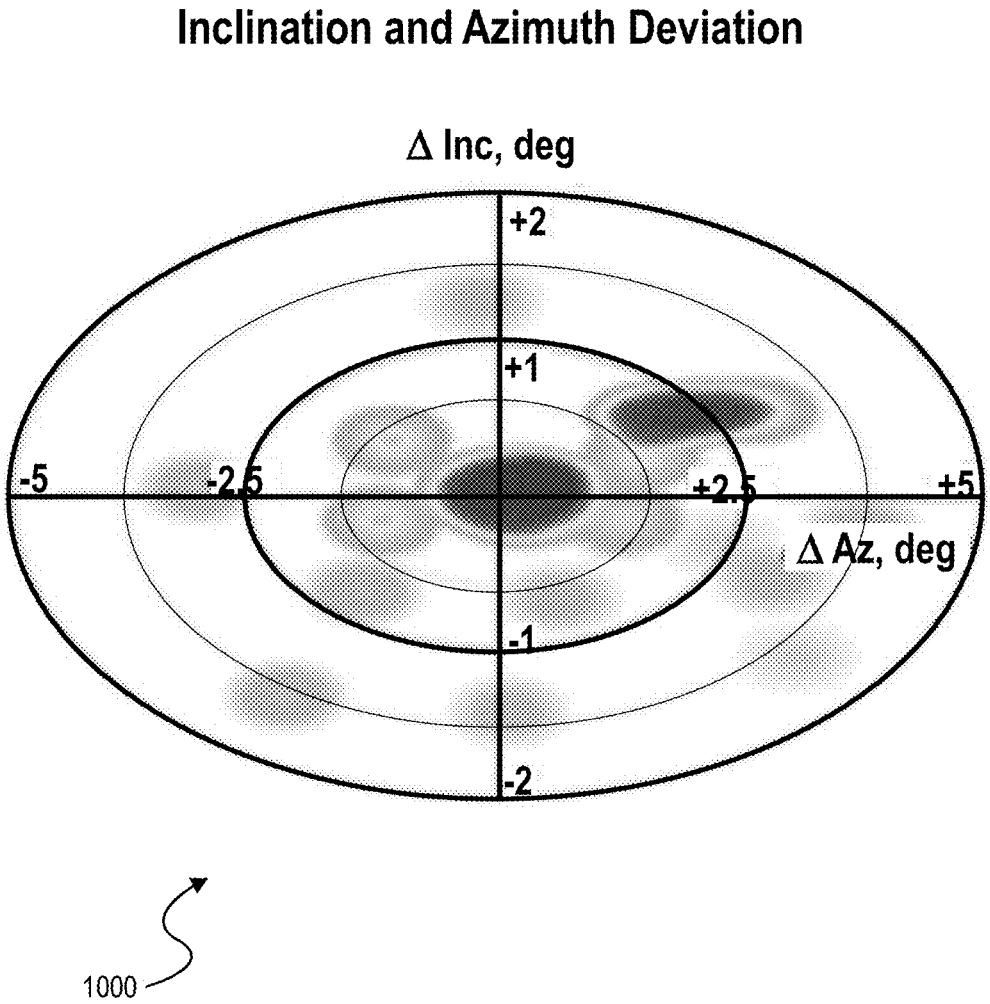
FIG. 10 is a partial screenshot showing an inclination and azimuth out-of-tolerance heatmap according to various embodiments.

FIG. 10 is a partial screenshot 1000 showing an inclination and azimuth out-of-tolerance heatmap according to various embodiments. The screenshot 1000 conveys information similar to that of the screenshot 800 as shown and described herein in reference to FIG. 8, except the focus is on the combined deviation on both azimuth and inclination at the same time in a polar heatmap plot. In particular, the shading indicates both the location and amount of deviation. This functionality allows a user to not only understand the combined deviation in azimuth and inclination, but also to grasp the direction of that deviation, with the colored heatmap showing the areas where the deviation is mostly concentrated in. In general, although the screenshot 1000 depicts a circle, an actual shape of steering commands is not necessarily a circle or an ellipse, and embodiments may depict any shape, e.g., depending on the respective tolerances on the inclination and azimuth.

Figure 11:
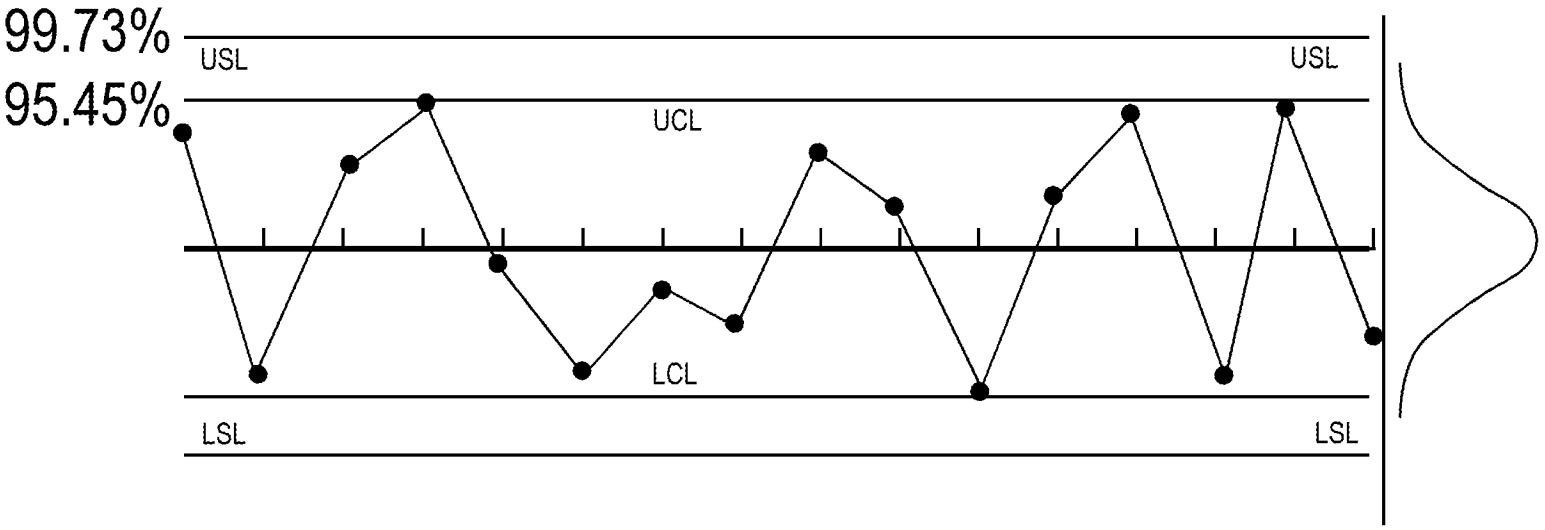
FIG. 11 depicts a graph showing drilling parameter upper and lower control and specification limits according to various embodiments.

FIG. 11 depicts a graph 1100 showing drilling parameter upper and lower control and specification limits according to various embodiments. According to various embodiments, any of a variety of techniques may be used to define proper tolerances for determining out-of-tolerance thresholds. By way of non-limiting example, statistical control methods may be used to understand the tool responses and identify out-of-tolerance issues. As shown in FIG. 11, upper and lower control limits at two standard deviations from the mean may be used to define out-of-tolerance for alerts for warning, and upper and lower specification limits at three standard deviations from the mean may be used to define out-of-tolerance alerts for failures. The mean and standard deviations may be determined from past wellbore drilling operations at the same and/or at different wellsites.

Figure 12:
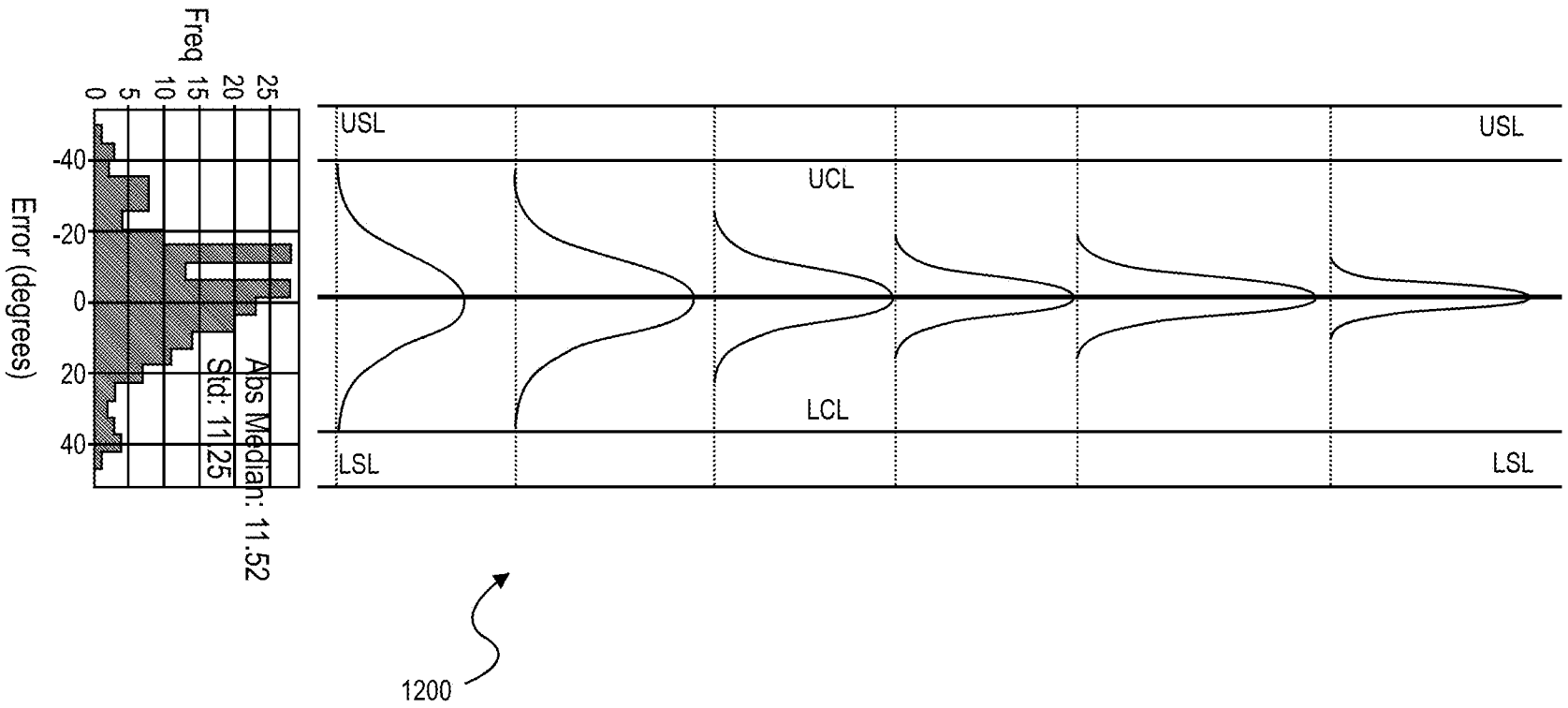
FIG. 12 schematically depicts a statistical control process improvement over time according to various embodiments.

FIG. 12 schematically depicts a statistical control process improvement over time 1200 according to various embodiments. The x-axis depicts time, and the y-axis depicts well parameter deviations from active drill plans (middle line). As shown in FIG. 12, as additional wellbore data becomes available from additional jobs over time, and as an embodiment is applied to handle deviations from active working drill plans, the width of the out-of-tolerance regions are expected to decrease as the standard deviations of the drill deviation data decrease. Thus, embodiments are expected to not only improve drilling a single wellbore by handling deviations within stands, but also improve drilling wellbores at any site over time as embodiments are used in the field and new jobs improve in accuracy.

Figure 13:
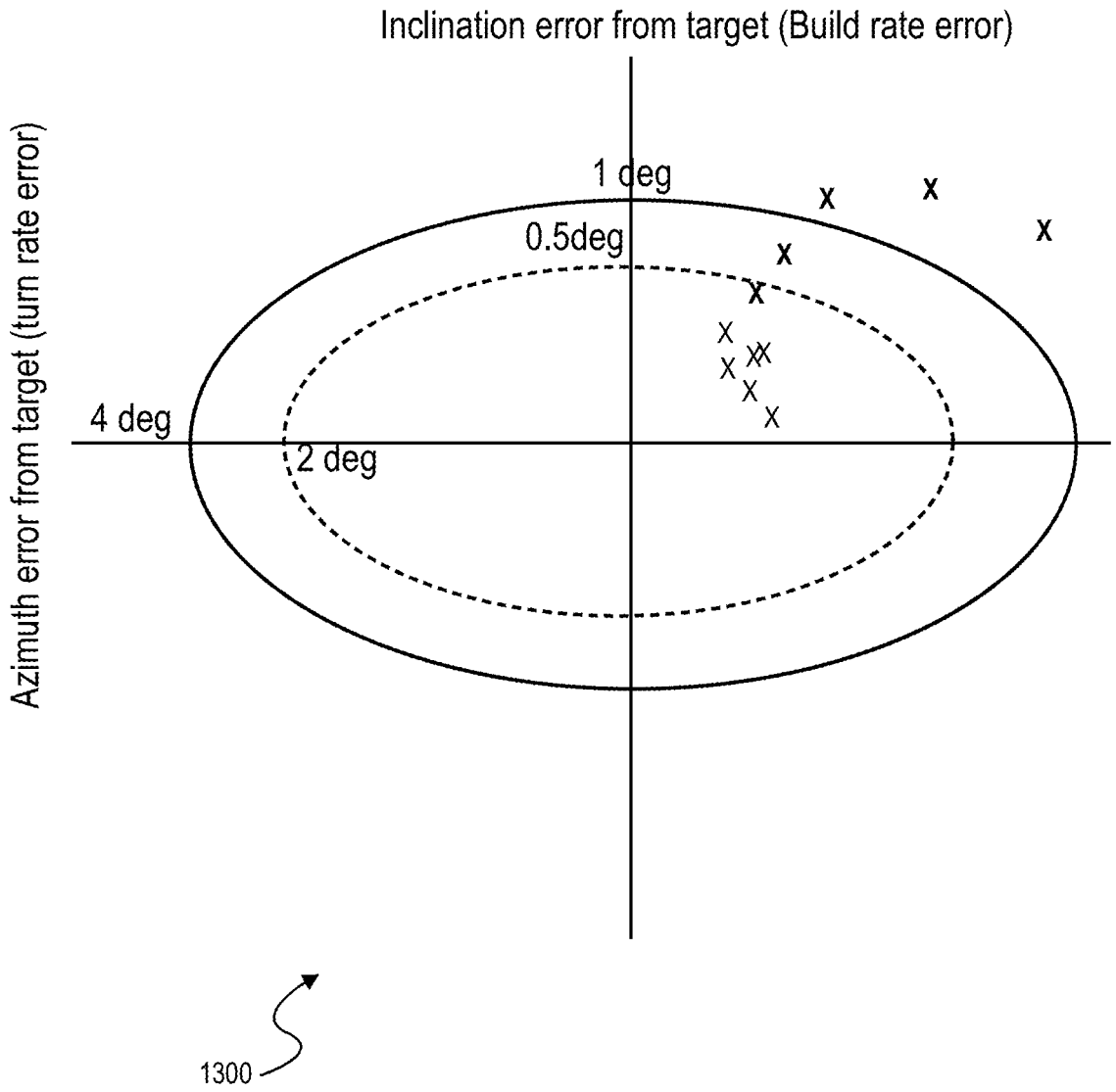
FIG. 13 is a graphical depiction of a multivariate statistical control process for inclination and azimuth according to various embodiments.

FIG. 13 is a graphical depiction of a multivariate statistical control process 1300 for inclination and azimuth according to various embodiments. By way of non-limiting example, the two drilling parameters depicted in FIG. 13 are inclination and azimuth. However, embodiments may utilize any combination drilling parameters. Because two drilling parameters are used, the out-of-tolerance thresholds appear as ovals, rather than rectangular boundaries (e.g., as shown and described herein in reference to FIGS. 8, 9, 11, and 12. Such oval thresholds may be used, e.g., for a heatmap as shown and described herein in reference to FIGS. 10 and 14.

Figure 14:
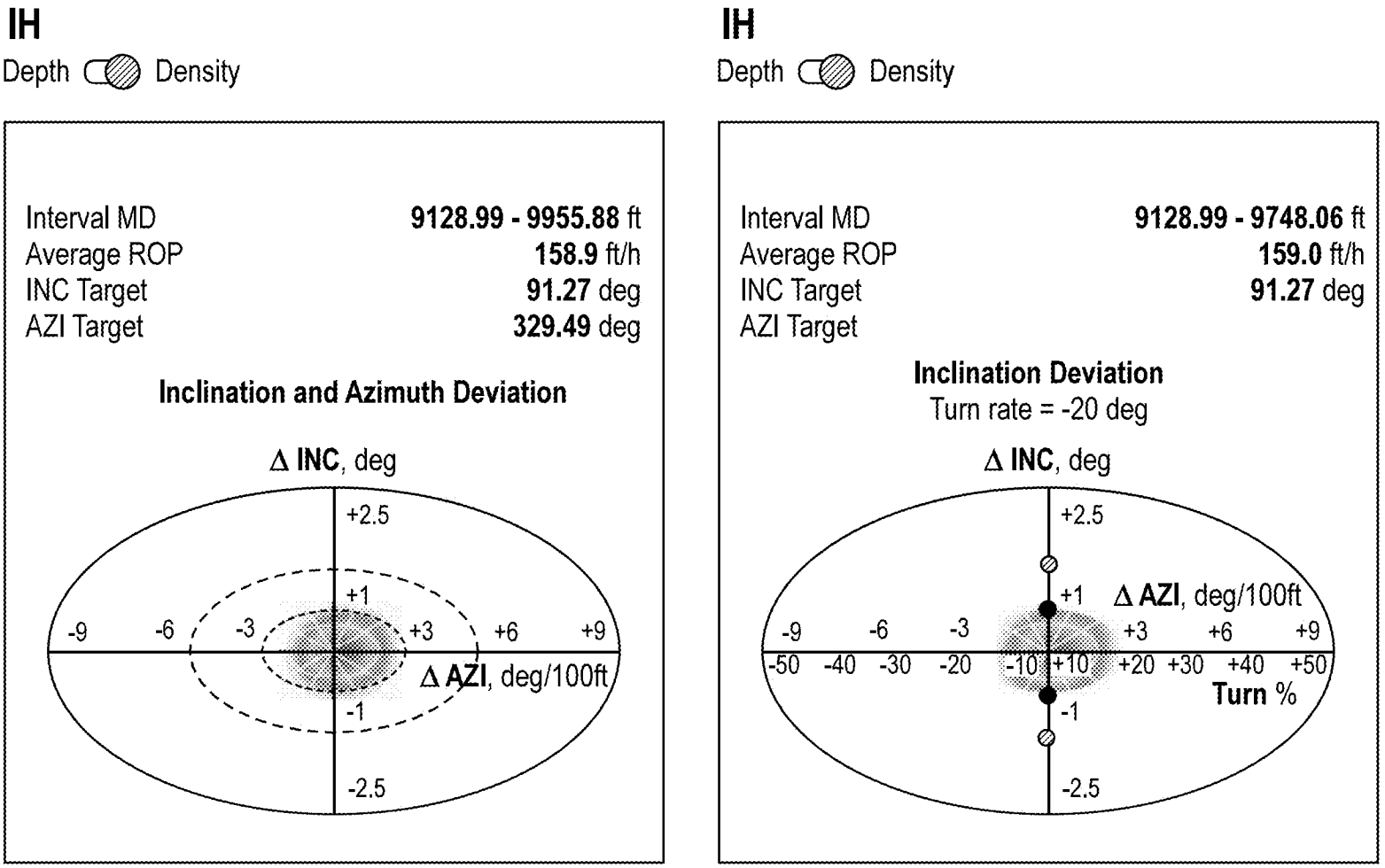
FIG. 14 is a partial screenshot depicting inclination-hold deviation maps according to various embodiments.

FIG. 14 is a partial screenshot depicting inclination-hold deviation maps 1402, 1404 according to various embodiments. In both 1402 and 1404, the inclination deviation is represented on the y-axis, whereas the azimuth rate of change (curvature) is represented on the x-axis.

In the deviation map 1402, the azimuth deviation is represented on the x-axis as change in degrees. The tolerances are shown as dotted ovals. In the deviation map 1404, the azimuth deviation is represented on the x-axis as turn percentage. The tolerances are shown as dots on the y-axis. In particular, in the deviation map 1404, the dots on the y-axis represent tolerances for inclination, with the black dots indicating a warning outside of ±1°, and the shaded dots indicating a red flag (e.g., a failure) outside of ±1.5°.

Note that embodiments can be used with or without inclination-hold (IH), hold-azimuth-inclination (HIA), or auto-curve. In general, auto-curve refers to a process where dogleg severity and/or toolface is monitored for significant deviations, and other parameters (e.g., dogleg severity, toolface, steering ratio, target, rate of penetration, target) are allowed to vary.

Figure 15:
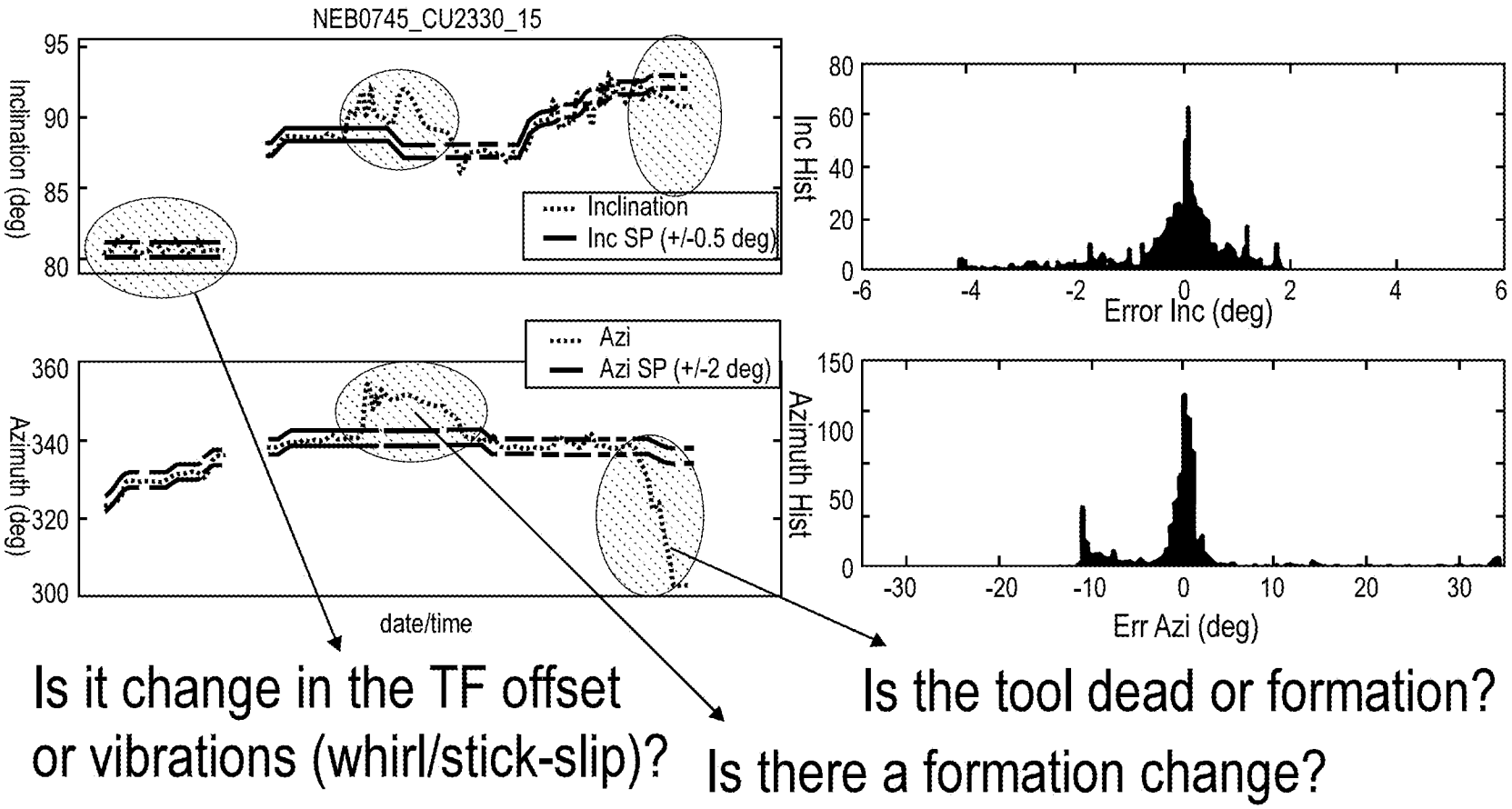
FIG. 15 is a graphical depiction of a multivariate statistical control process for inclination and azimuth showing annotated out-of-tolerance portions according to various embodiments.

FIG. 15 is a graphical depiction 1500 of a multivariate statistical control process for inclination and azimuth showing annotated out-of-tolerance portions according to various embodiments. Inclination is depicted in the top row, and azimuth is depicted in the bottom row. Graphs showing out-of-tolerance boundaries and actual states are shown on the left, with out-of-tolerance states annotated by shaded ovals. This and other out-of-tolerance annotations allow a user to pose questions regarding the cause of such deviations. Graphs showing amount of error (e.g., out-of-tolerance amount) in degrees are shown on the right. The graphical depiction 1500 may be shown in an application according to various embodiments.

Although some embodiments are shown and described herein as using statistical control processes to determine out-of-tolerance thresholds, embodiments are not so limited. According to various embodiments, out-of-tolerance thresholds may be determined using any technique, such as statistical control processes or machine learning, by way of non-limiting examples. Non-limiting example machine learning techniques include generative artificial intelligence models and large language models. Furthermore, threshold selection may take into account any of a variety of quantitative or qualitative considerations, including any, or any combination, of, for example: downhole tool type (e.g., orbit, X6, Noesteer, Xcel, Xceed, etc.), the specific basin where the well is drilled, the clients and their tolerances, the type of wells, and/or user preferences.

Figure 16:
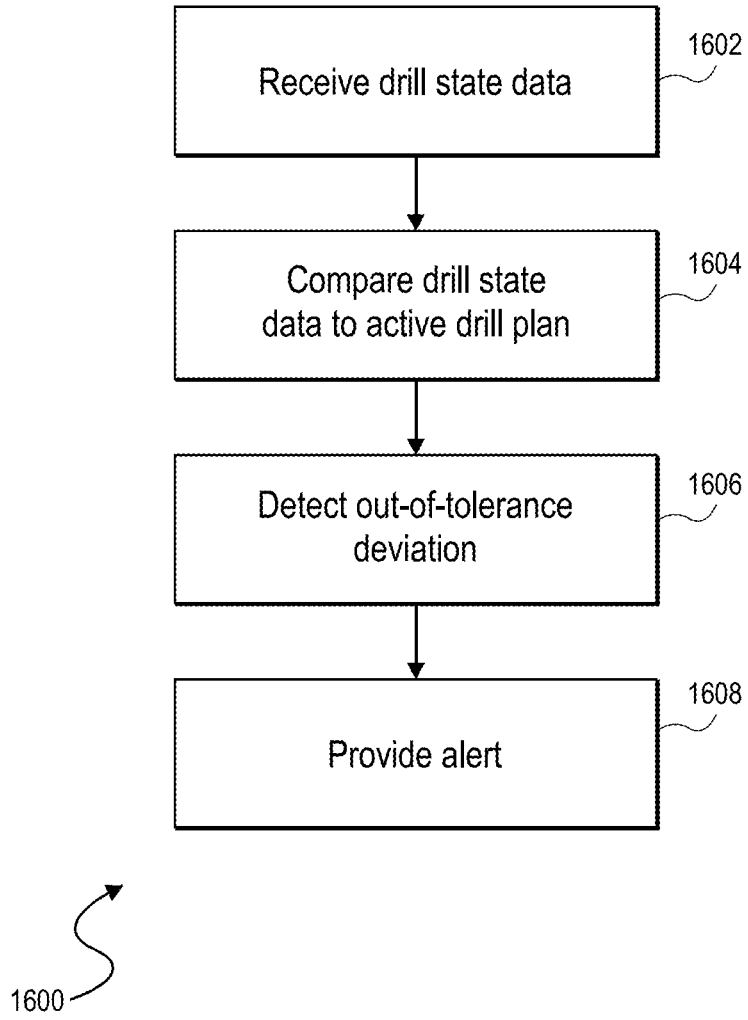
FIG. 16 is a flow chart depicting a method of drill deviation handling within a stand while drilling a wellbore according to various embodiments.

FIG. 16 is a flow chart depicting a method 1600 of drill deviation handling within a stand while drilling a wellbore according to various embodiments. The method 1600 may be implemented using hardware as shown and described herein, e.g., in reference to any of FIGS. 1-4.

At 1602, the method 1600 includes receiving, by an electronic processor and during a stand, drill state data. The drill state data may be received during a stand, as opposed to between stands. The drill state data may include actual values for any drill state data, e.g., as shown and described herein in reference to FIGS. 1-14, such as: azimuth, inclination, dogleg severity, turn rate, build rate real time yield, toolface offset, revolutions per minute (RPM), weight on bit, rate of penetration, or flow.

At 1604, the method 1600 includes comparing, by the electronic processor and during the stand, the drill state data to an active drill plan. The comparison may include, for example, determining whether the drill state data significantly deviates from the active drill plan. For example, the comparison may include determining whether the drill state data is out-of-tolerance as compared to the drill state plan. Any of a variety of parameters may be compared, such as, by way of non-limiting examples: azimuth, inclination, dogleg saturation, turn rate, build rate real time yield, toolface offset, revolutions per minute (RPM), weight on bit, rate of penetration, flow, downlink reception, tool malfunction, or steering efficiency factor. Any of a variety of techniques may be used to determine out-of-tolerance boundaries, e.g., machine learning or statistical process control, such as is shown and described herein in reference to FIGS. 11-13. Non-limiting example machine learning techniques include generative artificial intelligence models and large language models.

At 1606, the method 1600 includes detecting, by the electronic processor and based on the comparing, an out-of-tolerance deviation of a drill parameter. The detecting may include obtaining a result of the comparison of 1604, for example.

At 1608, the method 1600 includes providing, by the electronic processor, an alert of the out-of-tolerance deviation. The alert may be any of a variety of forms, such as are shown and described herein in reference to any of FIGS. 7-10 or 15. The alert may be graphical, textual, audible, or a combination thereof. Audible alerts may include delivery of computer-generated voice that depicts any of the characteristics shown graphically, and described herein, in reference to FIGS. 7-10, by way of non-limiting example.

Certain examples may be performed using a computer program or set of programs. The computer programs may exist in a variety of forms both active and inactive. For example, the computer programs may exist as software program(s) comprised of program instructions in source code, object code, executable code or other formats; firmware program(s), or hardware description language (HDL) files. Any of the above may be embodied on a transitory or non-transitory computer readable medium, which include storage devices and signals, in compressed or uncompressed form. Exemplary computer readable storage devices include conventional computer system RAM (random access memory), ROM (read-only memory), EPROM (erasable, programmable ROM), EEPROM (electrically erasable, programmable ROM), flash memory, and magnetic or optical disks or tapes.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, may be implemented using computer readable program instructions that are executed by an electronic processor.

These computer readable program instructions may be provided to a processor of a general-purpose computer, special purpose computer, or other programmable data processing apparatus to produce a machine, such that the instructions, which execute via the electronic processor of the computer or other programmable data processing apparatus, create means for implementing the functions/acts specified in the flowchart and/or block diagram block or blocks. These computer readable program instructions may also be stored in a computer readable storage medium that may direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

In embodiments, the computer readable program instructions may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the C programming language or similar programming languages. The computer readable program instructions may execute entirely on a user's computer, partly on the user's computer, as a stand-alone software package, partly on the user's computer and partly on a remote computer or entirely on the remote computer or server.

As used herein, the terms "A or B" and "A and/or B" are intended to encompass A, B, or {A and B}. Further, the terms "A, B, or C" and "A, B, and/or C" are intended to encompass single items, pairs of items, or all items, that is, all of: A, B, C, {A and B}, {A and C}, {B and C}, and {A and B and C}. The term "or" as used herein means "and/or."

As used herein, language such as "at least one of X, Y, and Z," "at least one of X, Y, or Z," "at least one or more of X, Y, and Z," "at least one or more of X, Y, or Z," "at least one or more of X, Y, and/or Z," or "at least one of X, Y, and/or Z," is intended to be inclusive of both a single item (e.g., just X, or just Y, or just Z) and multiple items (e.g., {X and Y}, {X and Z}, {Y and Z}, or {X, Y, and Z}). The phrase "at least one of" and similar phrases are not intended to convey a requirement that each possible item must be present, although each possible item may be present.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112 (f). However, for any claims containing elements designated in any other manner, it is intended that such elements are not to be interpreted under 35 U.S.C. § 112 (f).

While the invention has been described with reference to the exemplary examples thereof, those skilled in the art will be able to make various modifications to the described examples without departing from the true spirit and scope. The terms and descriptions used herein are set forth by way of illustration only and are not meant as limitations. In particular, although the method has been described by examples, the steps of the method may be performed in a different order than illustrated or simultaneously. Those skilled in the art will recognize that these and other variations are possible within the spirit and scope as defined in the following claims and their equivalents.

What is claimed is:

1. A method of drill deviation handling within a stand while drilling a wellbore, the method comprising:

receiving, by an electronic processor and during a stand, drill state data, wherein the drill state data comprises at least one of: Rotary Steerable System (RSS) data, Measurement While Drilling (MWD) data, Logging While Drilling (LWD) data, and mud motor steering data;

comparing, by the electronic processor and during the stand, the drill state data to an active drill plan;

detecting, by the electronic processor and based on the comparing, an out-of-tolerance deviation among a plurality of drill parameters;

providing, by the electronic processor, an alert of the out-of-tolerance deviation, wherein the alert comprises a depiction of the plurality of drill parameters, wherein the depiction comprises an annotation of an out-of-tolerance portion;

triggering a working plan generation during the stand, wherein the triggering is performed during the stand and without attaching an additional stand to a drillstring at a surface of the wellbore; and automatically adjusting the drilling based on the out-of-tolerance deviation, wherein the adjusting is performed during the stand and without attaching an additional stand to the drillstring at the surface of the wellbore.

2. The method of claim 1, further comprising depicting the out-of-tolerance deviation in a color different from an in-tolerance portion.

3. The method of claim 1, wherein the active drill plan comprises specifications of a plurality of: azimuth, inclination, dogleg saturation, turn rate, build rate real time yield, toolface offset, revolutions per minute (RPM), weight on bit, rate of penetration, and flow, and wherein the comparing comprises applying a statistical control process, and wherein the plurality of drill parameters comprises a plurality of: azimuth, inclination, dogleg saturation, turn rate, build rate, real time yield, toolface offset, revolutions per minute (RPM), weight on bit, rate of penetration, flow, toolface target, rate of penetration target, steering ratio, and dogleg severity.

4. The method of claim 1, wherein the depiction is of at least one of an inclination, an azimuth, a dogleg severity, a turn rate, or a build rate, and wherein the annotation of the out-of-tolerance portion comprises a shape indicative of out-of-tolerance.

* * * * *